US008096768B1

(12) United States Patent
Liang

(10) Patent No.: US 8,096,768 B1
(45) Date of Patent: Jan. 17, 2012

(54) TURBINE BLADE WITH TRAILING EDGE IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 520 days.

(21) Appl. No.: 12/365,396

(22) Filed: Feb. 4, 2009

(51) Int. Cl.
*F01D 5/08* (2006.01)
*F01D 5/18* (2006.01)

(52) U.S. Cl. ..... 416/97 R; 416/96 R; 416/226; 415/116

(58) Field of Classification Search ..... 416/1, 96 R, 416/97 R, 224, 226; 415/116
See application file for complete search history.

(56) References Cited

U.S. PATENT DOCUMENTS

| | | | | |
|---|---|---|---|---|
| 6,347,923 | B1 * | 2/2002 | Semmler et al. | 416/97 R |
| 7,156,620 | B2 * | 1/2007 | Papple | 416/96 R |
| 2007/0258815 | A1 * | 11/2007 | Liang | 416/97 R |

* cited by examiner

*Primary Examiner* — Kiesha Bryant
*Assistant Examiner* — Abbigale Boyle
(74) *Attorney, Agent, or Firm* — John Ryznic

(57) ABSTRACT

A turbine blade for an industrial gas turbine engine, the blade includes a squealer pocket formed by a pressure side tip rail and a suction side tip rail with tip cooling holes opening onto the tip floor in the trailing edge region, a tip corner and two impingement cooling air exit slots formed between the pressure side and the suction side tip rails and the tip corner. The cooling air flowing along the tip pocket flows out the exit slots as impingement jets and provide cooling for the tip corner to prevent an over-temperature that results in erosion.

13 Claims, 5 Drawing Sheets

TURBINE BLADE WITH TRAILING EDGE IMPINGEMENT COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with trailing edge cooling.

2. Description of the Related Art Including Information Disclosed Under 37 CFR 1.97 and 1.98

A gas turbine engine, such as an industrial gas turbine engine, includes a turbine with multiple stages or rows of turbine blade and vanes to convert the energy from a hot gas flow into rotational energy in the turbine to drive the rotor shaft. The first stage turbine airfoils—which include rotor blades and stator vanes—are exposed to the highest temperature gas flow from the combustor and therefore require more cooling than the latter stage airfoils. Allowing for higher turbine inlet temperatures will increase the efficiency of the engine, a turbine airfoil designer tries to reach a balance between performance and long part life for parts such as a turbine rotor blade. An industrial gas turbine engine is operated for long periods of time before a shut-down occurs. Thus, any degradation of an airfoil will result in lower performance and shorter part life.

FIG. 1 shows a prior art first or second stage turbine blade used in an industrial gas turbine engine. The turbine rotor blade with a squealer tip formed on the blade tip that is formed by a pressure side tip rail and a suction side tip rail that extends around the leading edge to form a continuous tip rail. FIG. 2 shows a cross section view through the spanwise axis of the turbine blade of FIG. 1 with a 1+3 serpentine flow cooling circuit to provide cooling for the blade. The blade includes a leading edge cooling supply channel 11 to supply pressurized cooling air from a source outside of the blade, a leading edge impingement cavity 12 connected to the supply channel 11 by a row of metering and impingement holes 13 formed in the rib that separates these two cooling air passages, and a showerhead arrangement of film cooling holes to discharge film cooling air from the leading edge impingement cavity 12 onto the leading edge surface of the airfoil. This provides the cooling for the leading edge region of the blade airfoil.

The airfoil mid-chord region—region between the leading edge region and the trailing edge region—is cooled by a forward flowing 3-pass (triple pass) serpentine flow cooling circuit that includes a first leg or supply leg 21 located adjacent to the trailing edge region, a second leg 22 that flows downward, and a third or last leg 23 that flows upward located adjacent to the leading edge cooling supply channel 11. The third leg 23 is connected to rows of pressure side film cooling holes and suction side film cooling holes. The first leg 21 includes a row of pressure side film cooling holes.

The trailing edge region is cooled by a trailing edge cooling air supply channel 31 that supplies cooling air to ribs having metering and impingement holes therein to produce impingement cooling for the trailing edge region. Double or triple impingement cooling can be used. A first rib include first row of metering holes to meter the cooling air and produce impingement cooling on the second rib. The second rib includes a row of metering holes to produce a second impingement cooling. The spent impingement cooling air is then discharged out through a row of cooling holes located along the trailing edge of the airfoil. FIG. 3 shows a diagram view of the blade internal cooling circuitry for this design. FIG. 4 shows a cross section side view of the internal cooling circuitry for this blade design.

For the blade trailing edge tip section, the prior art turbine blade of FIGS. 1 through 6 include a pressure side bleed tip rail design as seen in FIGS. 5 and 6 which produces a hot spot 32 on the suction side tip rail and the blade tip end corner regions. The blade tip includes a squealer pocket 33 with tip cooling holes 34 connected to the internal cooling circuitry to discharge cooling air onto the tip floor and squealer pocket. A row of cooling slots are positioned on the pressure side wall at the trailing edge region to discharge cooling air from the impingement cooling holes. Frequently, this region needs to be re-built during engine refurbishment. This hot section produces erosion at the point on the blade that results in short part life and a decrease in performance because the leakage grows as the erosion wears way material.

BRIEF SUMMARY OF THE INVENTION

It is an object of the present invention to provide for a turbine blade of the prior art in which the hot spot condition on the suction side tip rail is eliminated.

It is another object of the present invention to provide for a turbine blade of the prior art with an increased part life.

The objectives of the present invention are achieved with the use of an impingement cooling process in a conical blade tip corner design of the present invention. The blade tip includes the squealer pocket design of the prior art but with a trailing edge tip corner and two impingement cooling air exit slots located on the pressure side wall and the suction side wall between the tip rails and the tip corner. The cooling air discharged through the tip cooling holes flows along the tip floor in the squealer pocket and out through the two impingement holes and around the tip corner to eliminate the hot spot formed in the prior art blade tip.

DETAILED DESCRIPTION OF THE INVENTION

Figure 1:
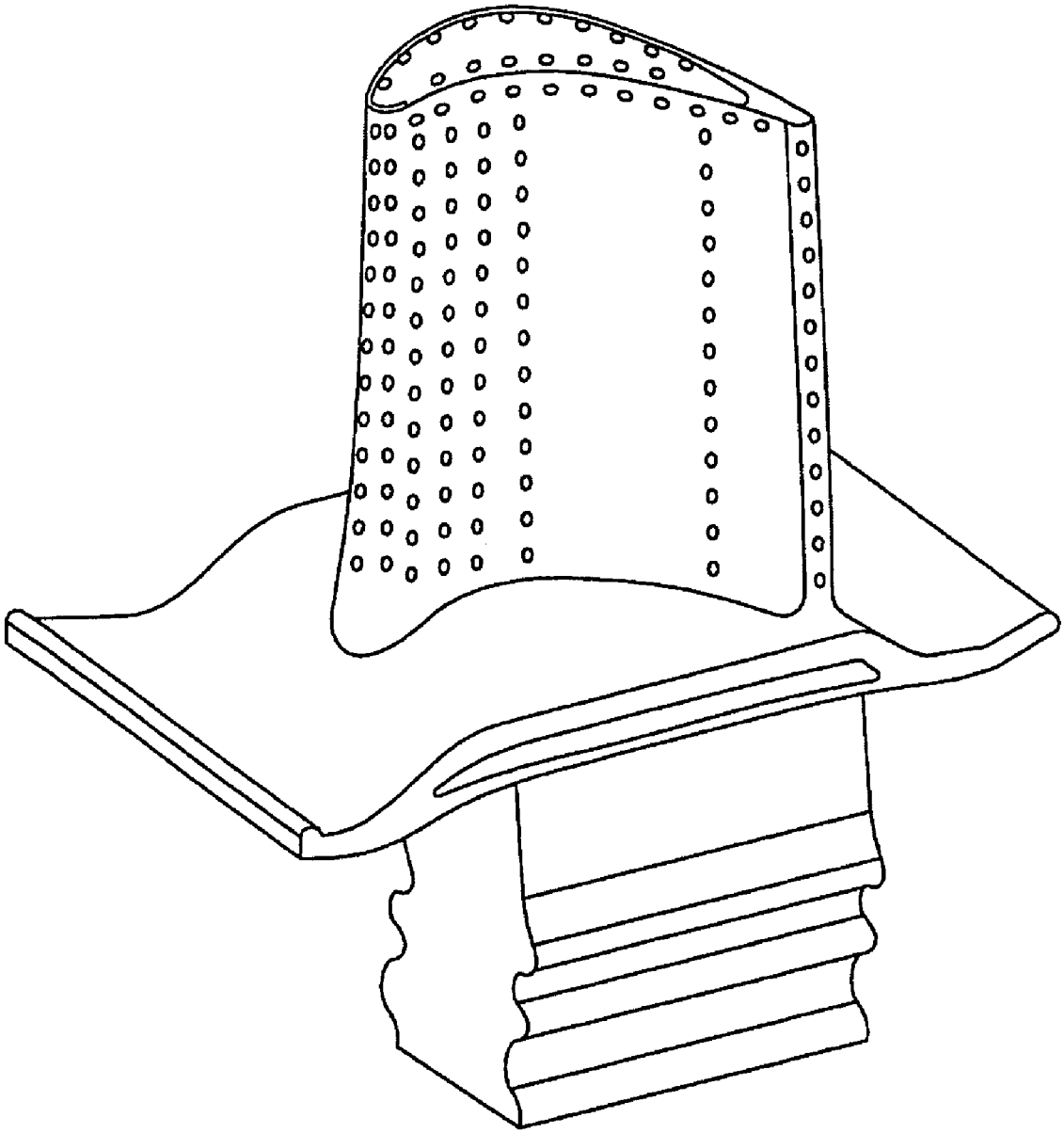
Fig 1 Prior Art
FIG. 1 shows a schematic view of a first or second stage turbine rotor blade of the prior art.
Figure 2:
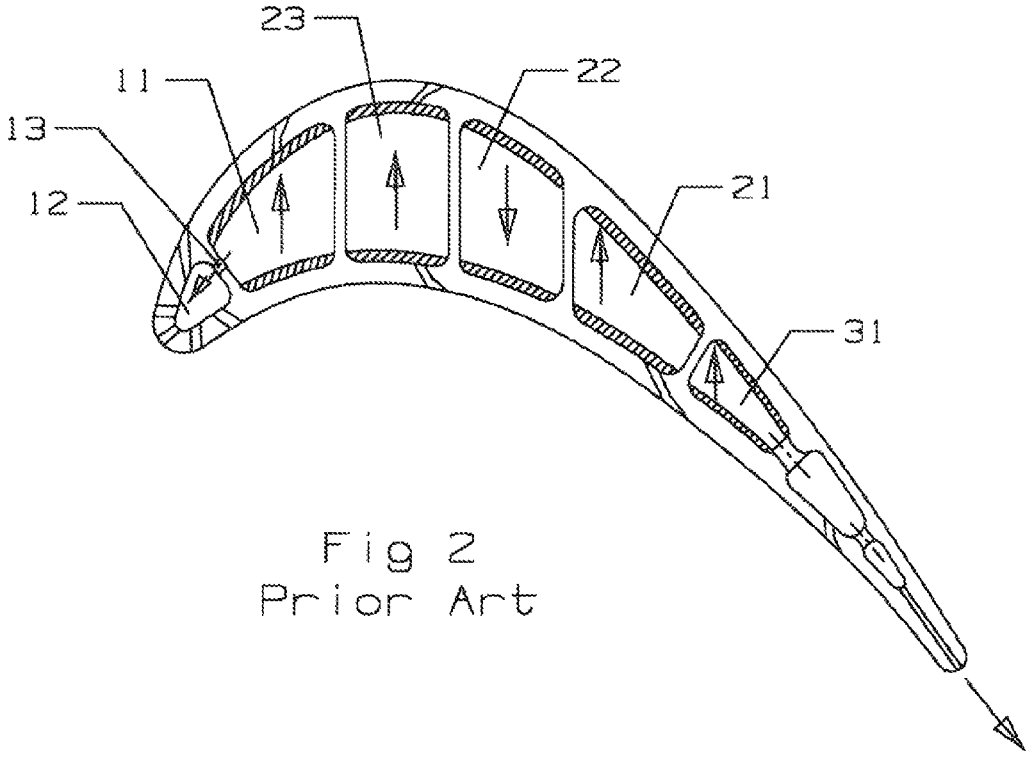
Fig 2 Prior Art
FIG. 2 shows a cross section view of the internal cooling circuitry of the prior art turbine blade of FIG. 1.
Figure 3:
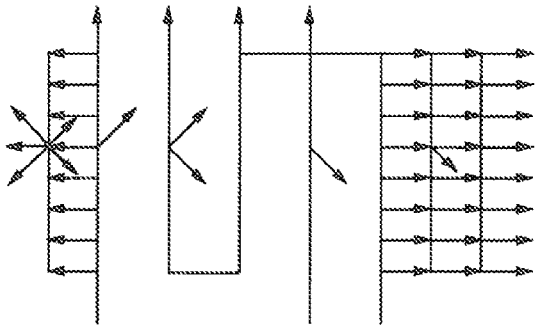
Fig 3 Prior Art
FIG. 3 shows a diagram view of the cooling air circuitry of the prior art turbine blade of FIG. 1.
Figure 4:
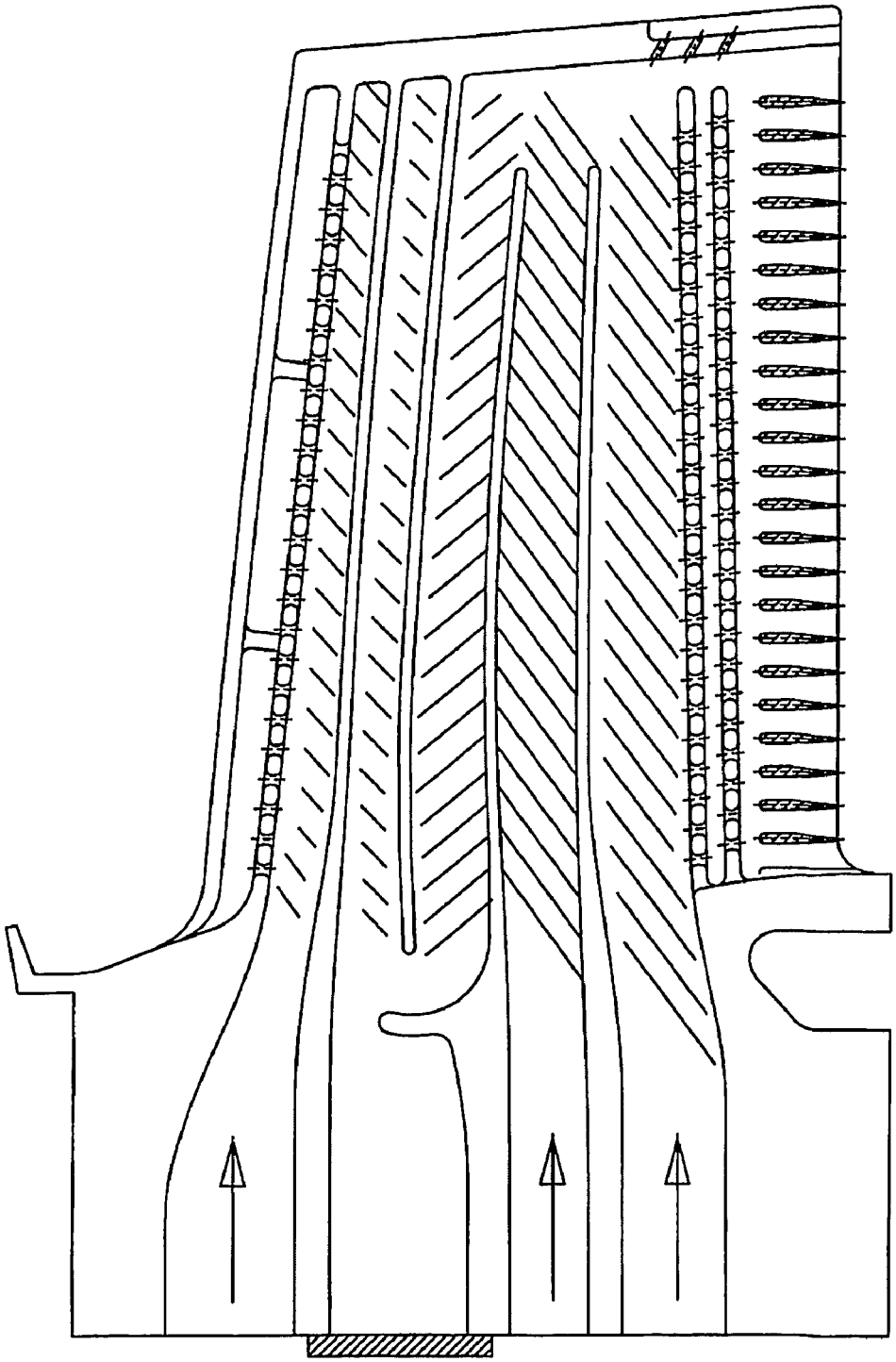
Fig 4 Prior Art
FIG. 4 shows a cross section side view of the internal cooling circuitry of the prior art turbine blade of FIG. 1.
Figure 5:
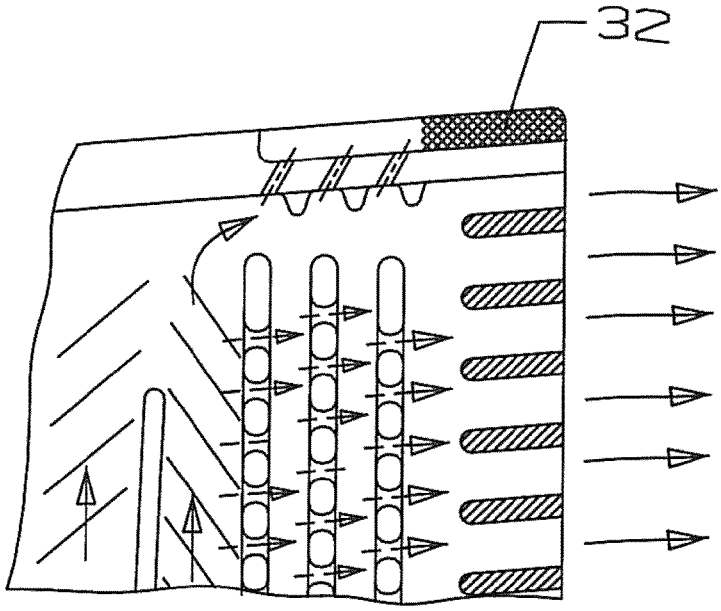
Fig 5 Prior Art
FIG. 5 shows a detailed view of the trailing edge tip corner cooling circuit for the prior art turbine blade of FIG. 1.
Figure 6:
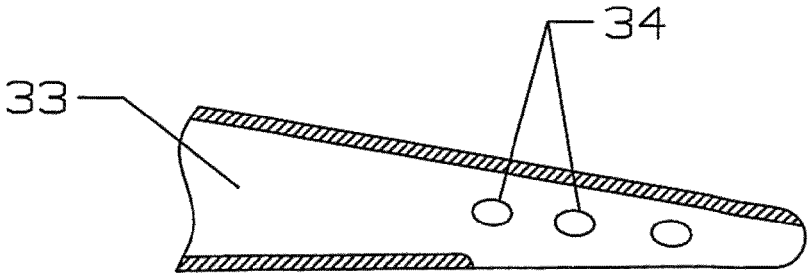
Fig 6 Prior Art
FIG. 6 shows a cross section top view of the trailing edge tip corner cooling circuit of the prior art turbine blade of FIG. 1.
Figure 7:
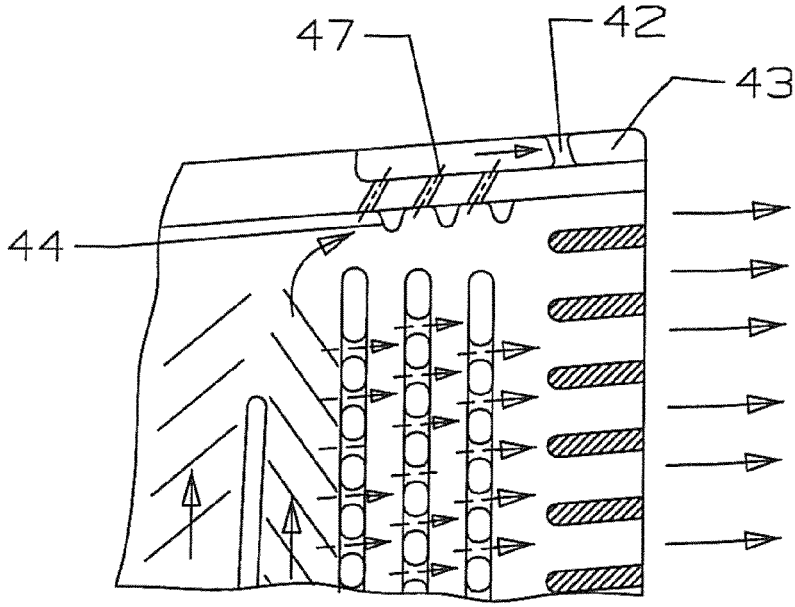
FIG. 7 shows a detailed view of the trailing edge tip corner cooling circuit for the turbine blade of the present invention.
Figure 8:
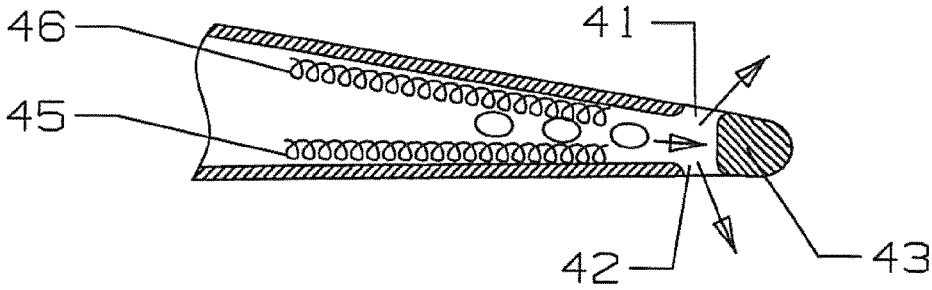
FIG. 8 shows a cross section top view of the trailing edge tip corner cooling circuit of the turbine blade of the present invention.

The turbine blade of the present invention is shown in FIGS. 7 and 8 and is basically the prior art turbine blade but with the addition of a trailing edge tip corner 43 as seen in FIG. 8 and two discharge cooling air slots 41 and 42 located between the tip rails and the tip corner. The squealer pocket is formed by a pressure side tip rail and the suction side tip rail. Tip cooling holes 47 open onto the tip floor in the trailing edge region of the squealer pocket. Trip strips 44 are located under the tip pocket to promote heat transfer. The discharge cooling air slots 41 and 42 form jets to discharge the cooling air. As seen in the figures, the discharge cooling air slots 41 and 42 both are open on the top side to form a gap between the tip rails and the tip corner 43.

As seen in FIG. 7, the exit slots are flush with the tip cap floor. The tip rails on the pressure side and suction side are the same height as the tip corner.

In operation, due to a pressure gradient across the airfoil from the pressure side to the suction side, the secondary flow near the pressure side surface is migrated from the lower blade span upward across the blade end tip. As the secondary leakage flow flows across the blade tip, vortex flow 45 and 46 is formed along the inner corner of the pressure and suction tip rails as seen in FIG. 8. These vortices 45 and 46 are formed primarily of cooling air injected along the squealer pocket next to the tip rails. The convergent channel formed by the airfoil pressure side and suction side tip rail will direct the vortex flow to impinge onto the backside of the blade tip rail corner and therefore provide impingement cooling to the blade trailing edge tip rail corner and enhance the local tip section cooling and flow distribution. The tip cooling circuit of the present invention eliminates the airfoil tip corner over-temperature issue described in the prior art turbine blade above.

I claim the following:

1. A turbine rotor blade comprising:

a serpentine flow cooling circuit in a mid-chord region of the blade;

a multiple impingement cooling circuit located in the trailing edge region of the blade;

a blade tip squealer pocket formed by a pressure side tip rail and a suction side tip rail;

a plurality of tip exit cooling holes located in the trailing edge region of the tip pocket;

a trailing edge tip corner located on the trailing edge of the tip;

a pressure side cooling air exit slot located between the tip corner and the pressure side tip rail;

a suction side cooling air exit slot located between the tip corner and the suction side tip rail; and, the trailing edge region tip cooling holes open midway between the pressure side tip rail and the suction side tip rail.

2. The turbine rotor blade of claim 1, and further comprising:

the pressure side and suction side cooling air exit slots form discharge jets.

3. The turbine rotor blade of claim 1, and further comprising:

an underside of the tip floor at the tip cooling holes includes trip strips extending into the internal cooling circuit of the blade.

4. The turbine rotor blade of claim 1, and further comprising:

a row of exit slots located on the pressure side wall of the trailing edge region of the blade and connected to the impingement cooling circuit to discharge cooling air; and, the trailing edge tip corner has a chordwise length slightly less than the chordwise length of the exit slots.

5. The turbine rotor blade of claim 1, and further comprising:

the turbine rotor blade is an industrial gas turbine first or second stage rotor blade.

6. The turbine rotor blade of claim 1, and further comprising:

the pressure side and suction side exit slots both are open on the top side.

7. The turbine rotor blade of claim 1, and further comprising:

the tip corner and the pressure side tip rail and the suction side tip rail are the same height.

8. The turbine rotor blade of claim 1, and further comprising:

the exit slots are flush with the tip cap floor.

9. A turbine rotor blade comprising:

a cooling air channel located adjacent to a trailing edge region of the blade;

a multiple impingement cooling circuit located in the trailing edge region of the blade;

a blade tip squealer pocket formed by a pressure side tip rail and a suction side tip rail;

a row of tip cooling holes connected to the cooling air channel and opening into the blade tip squealer pocket in the trailing edge region of the blade tip;

a trailing edge tip corner located on the trailing edge of the tip;

a pressure side cooling air exit slot and a suction side cooling air exit slot formed between the tip rails and the trailing edge tip corner; and, the row of tip cooling holes are connected to both the pressure and suction side cooling air exit slots.

10. The turbine rotor blade of claim 9, and further comprising:

the row of tip cooling holes are slanted in a direction toward the trailing edge of the blade.

11. The turbine rotor blade of claim 9, and further comprising:

the pressure side and suction side exit slots are flush with the tip cap floor.

12. The turbine rotor blade of claim 9, and further comprising:

the pressure side and suction side exit slots both are open on the top side.

13. The turbine rotor blade of claim 9, and further comprising:

the tip corner and the pressure side tip rail and the suction side tip rail are the same height.

* * * * *